United States Patent [19]

Krull et al.

[11] 4,400,121

[45] Aug. 23, 1983

[54] RAILWAY CAR HITCH FOR A TRAILER

[75] Inventors: Joseph A. Krull, Philadelphia; Michael J. Pavlick, Norristown, both of Pa.

[73] Assignee: The Budd Company, Troy, Mich.

[21] Appl. No.: 228,377

[22] Filed: Jan. 26, 1981

[51] Int. Cl.[3] ..... B60P 3/07; B60P 7/13; B61D 3/16; B61D 45/00

[52] U.S. Cl. ..... 410/64; 280/433; 410/56

[58] Field of Search ..... 280/433; 410/56, 64

[56] References Cited

U.S. PATENT DOCUMENTS

| | | | |
|---|---|---|---|
| 1,272,486 | 7/1918 | McManis | 280/433 |
| 1,314,577 | 9/1919 | Dickerson | 280/433 |
| 2,811,374 | 10/1957 | Fuschi | 280/433 X |
| 2,936,983 | 5/1960 | Markestein et al. | 410/64 |
| 3,087,748 | 4/1963 | Livelsberger et al. | 410/64 X |
| 3,944,375 | 3/1976 | Ferris et al. | 410/64 |

*Primary Examiner*—Bruce H. Stoner, Jr.
*Assistant Examiner*—Howard Beltran
*Attorney, Agent, or Firm*—Edward M. Farrell; Herman Foster; Thomas I. Davenport

[57] ABSTRACT

A hitch mechanism connected to a freight car is disposed to receive a king pin of a trailer to be carried by the car. The hitch mechanism is adapted to be selectively opened to receive the king pin therein and then closed by a lever to secure the king pin in place. A latch mechanism automatically locks the hitch mechanism in a closed position after the hitch mechanism is closed. A manual operation of the latch mechanism is required before the hitch mechanism can be opened.

4 Claims, 7 Drawing Figures

FIG. 2
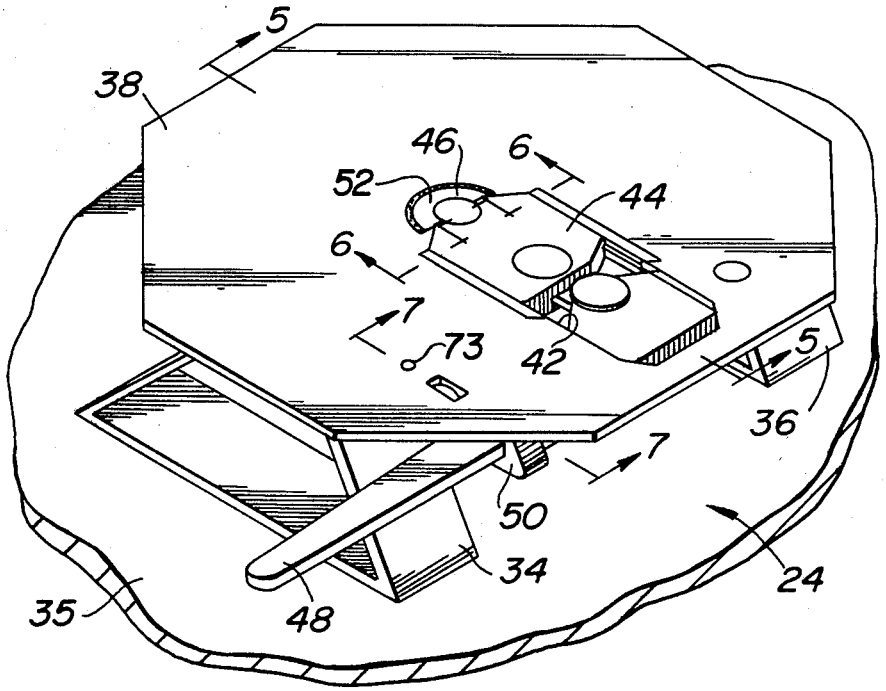
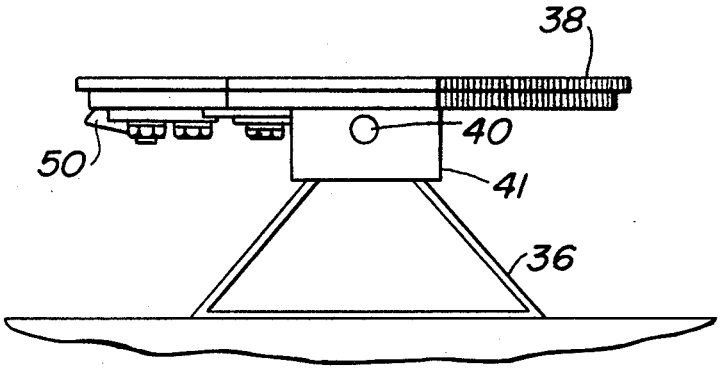
FIG. 4

RAILWAY CAR HITCH FOR A TRAILER

BACKGROUND OF THE INVENTION

Hitch mechanisms for trailers have taken a wide variety of different forms. For example, one type of mechanism used when the trailer is being attached to a tractor, includes a "V" opening to receive the king pin of the trailer when the tractor is being moved into position. After the king pin has been inserted into the opening, the hitch mechanism is closed to maintain the trailer attached to the tractor.

On so-called "piggy back" systems, a trailer is carried by a freight car. In these cases, the trailer is generally physically lifted, moved over the freight car and then lowered vertically with the king pin of the trailer being lowered into an opening of the hitch mechanism mounted to the freight car.

In the past, many such hitch mechanisms used in "piggy back" systems have involved movable locking elements which are opened or closed by screw mechanisms. For example, when the hitch is opened, a screw mechanism is in a first position. After the king pin of the trailer has been lowered into the opening of the hitch, a wrench is used to turn the screw mechanism to close the hitch. Additional safety means are sometimes then employed to maintain the hitch in a locked position.

The present invention is directed toward mechanisms specifically designed for freight cars for receiving and transporting a trailer. While the hitch mechanisms used heretofore have proven satisfactory in many cases, they have often required special tools to open and close the hitches. This sometimes is inconvenient and time consuming. Also, the additional safety means used to keep the hitch mechanisms closed often required a conscious manual operation of the person operating the hitch, an operation which may be overlooked.

OBJECTS OF THE INVENTION

It is an object of this invention to provide an improved hitch mechanism for a freight car for securing a trailer in place as it is being transported.

It is a further object of this invention to provide an improved hitch mechanism for a freight car for securing a trailer in place during transit in which no tools are required to open and close the hitch mechanism.

It is still a further object of this invention to provide an improved hitch mechanism for securing a trailer to a freight car during transit which includes an additional automatic safety lock after the hitch mechanism is closed and which requires a manual release before the hitch mechanism can be opened.

SUMMARY OF THE INVENTION

In accordance with the present invention, a hitch mechanism is connected to a freight car, preferably a low-level freight car. The hitch mechanism is adapted to be manually opened or closed by a lever. A spring biased safety latching mechanism is adapted to automatically lock the lever in place when the hitch mechanism is closed. The latching mechanism must be first manually released before the hitch mechanism can be opened. A trailer is adapted to be lowered on to the freight car, with the king pin of the trailer being moved into an opening of the hitch mechanism while it is open. The hitch is then manually closed and automatically locked in place.

Other objects and advantages of the present invention will be apparent and suggest themselves to those skilled in the art, from a reading of the following specification and claims, taken in conjunction with the accompanying drawings.

BRIEF DESCRIPTION OF THE DRAWINGS

FIG. 2 is an isometric view of a hitch mechanism embodying the present invention of the type which may be used in connection with FIG. 1;

FIG. 4 is a side view taken from the right side of the hitch mechanism illustrated in FIG. 2;

DETAILED DESCRIPTION OF THE PREFERRED EMBODIMENTS

Figure 1:
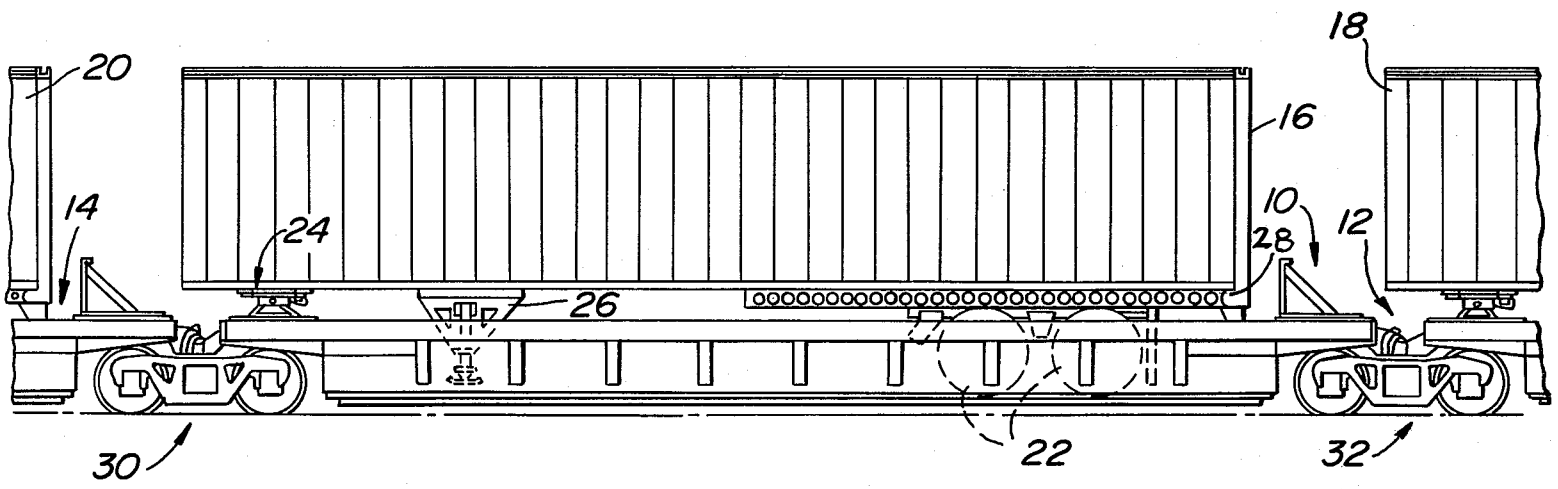
FIG. 1 is a side view illustrating one embodiment of the present invention with a low level freight car carrying a typical trailer.

Referring to FIG. 1, freight cars 10, 12 and 14 are illustrated carrying trailers 16, 18 and 20, respectively. The trailers may be of the type normally attached to tractors. The freight cars 10, 12 and 14 may be of the low level type, of the type described in copending application entitled "A Low Level Freight Car for Carrying Trailers", Ser. No. 147,965, filed May 8, 1980, and assigned to the same assignee as the present invention.

The trailer 16 includes conventional wheels 22, a trailer hitch mechanism 24 and a landing gear 26. The present invention is directed primarily to the trailer hitch mechanism 24, which will be shown and described in detail in connection with subsequent figures.

The trailer may include various conventional items such as positioning rails 28 and other elements as illustrated. Truck assemblies 30 and 32 are disposed on either side of the freight car unit 10. The truck assemblies 30 and 32 include elements found in conventional railway trucks including wheels associated with axle and brake assemblies. The details of these trucks are only incidentally related to the present invention and will not be shown or described in detail.

In general, in the "piggy back" system illustrated in FIG. 1, require that the trailers be first physically lifted and moved into positions over the freight cars. The trailers are then lowered with their respective king pins moving into openings in their respective hitch mechanisms.

Referring to the other figures of the drawings, FIG. 2 illustrates the hitch mechanism 24 in a closed position. The hitch mechanism includes pedestals 34 and 36 which are adapted to be attached to the mounting plate 35 of a freight car and support the main locking elements of the hitch mechanism 24. The mechanism 24 includes a top head member 38 supported on the pedestals 34 and 36 which holds the various movable locking or hitching elements as will be described. A retainer shaft 40 and block 41 on either side secures the top head member 38 to the pedestals 34 and 36 (FIG. 4).

The head member 38 includes a substantially rectangular opening 42 for receiving the movable members for locking the hitch mechanism 24. A movable jaw 44 is adapted to be selectively moved back and forth to open and close the hitch mechanism 24. When the movable jaw 44 is in a closed position, as illustrated in FIG. 2, a central opening 46 is provided to securely hold a king pin 47 (FIG. 6) of a trailer securely in place. The total opening in the hitch when it is open may be approximately 36 square inches. This makes it relatively easy to locate the king pin of a container into the opening because the diameter of the king pin may be in the order of 2 inches.

The movable jaw 44 is disposed to be opened and closed by a lever mechanism 48. A spring biased latch element 50 locks the lever mechanism in place when the hitch mechanism 24 is closed. The latch mechanism 50 automatically maintains the lever 48 and the movable jaw 44 is in a locked position when the hitch is closed. This provides a safety lock feature which does not require a positive action on the part of the person closing the hitch. When it is desired to open the hitch mechanism, the latch mechanism 50 must be manually operated against a bias of a spring to permit the lever arm 48 to be moved to move the movable jaw 44 out of a lcoking position.

Figure 3:
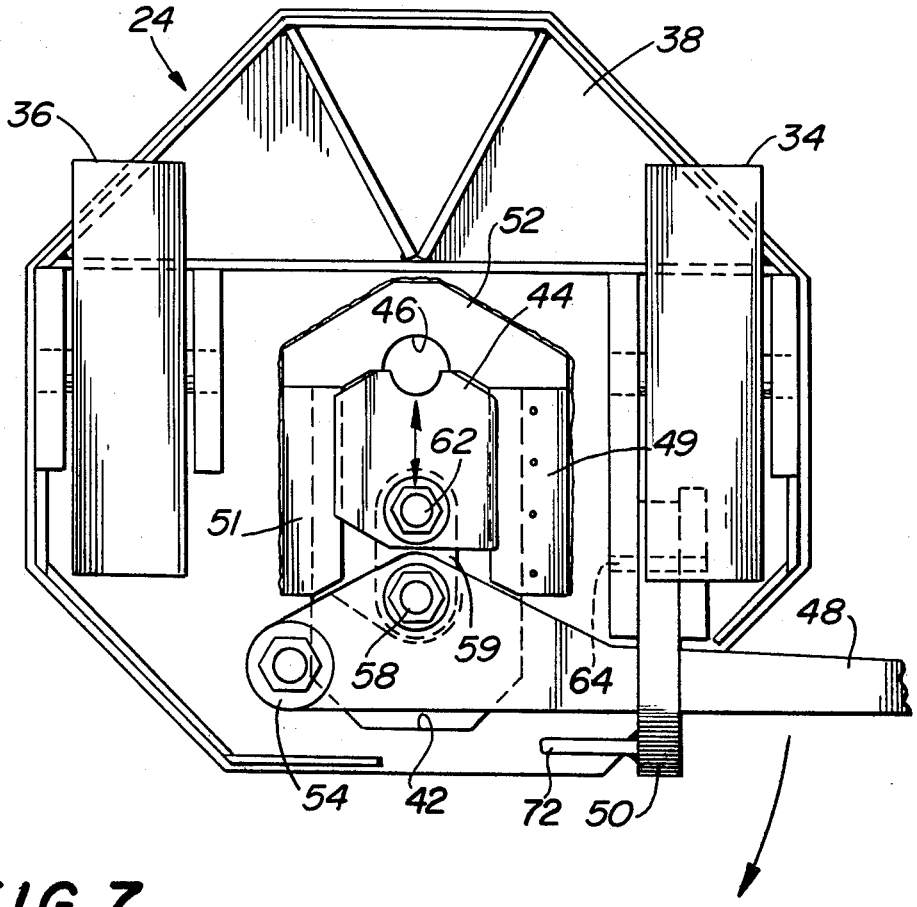
FIG. 3 is a bottom view of the hitch mechanism illustrated in FIG. 2.
Figure 6:
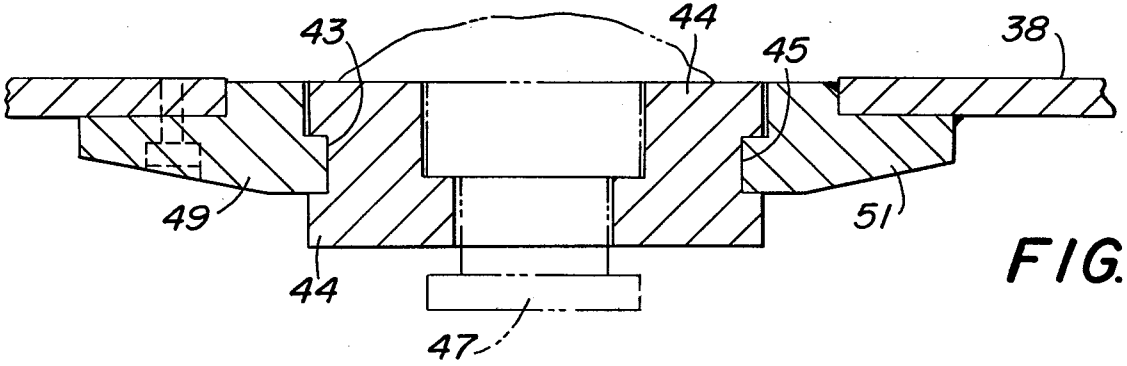
FIG. 6 is a cross-sectional view taken along lines 6—6 of FIG. 2.

Referring to FIG. 3, the movable jaw 44 is adapted to be moved away or toward a fixed jaw 52. The movable jaw 44 is adapted to be guided by a pair of slide members 49 and 51 (FIG. 6). As illustrated in FIG. 6, the movable jaw 44 include guiding grooves 43 and 45 to receive projection sections from the members 49 and 51, respectively, to permit a sliding and guiding movement of the movable jaw 44 to open or close the hitch mechanism 24.

Figure 5:
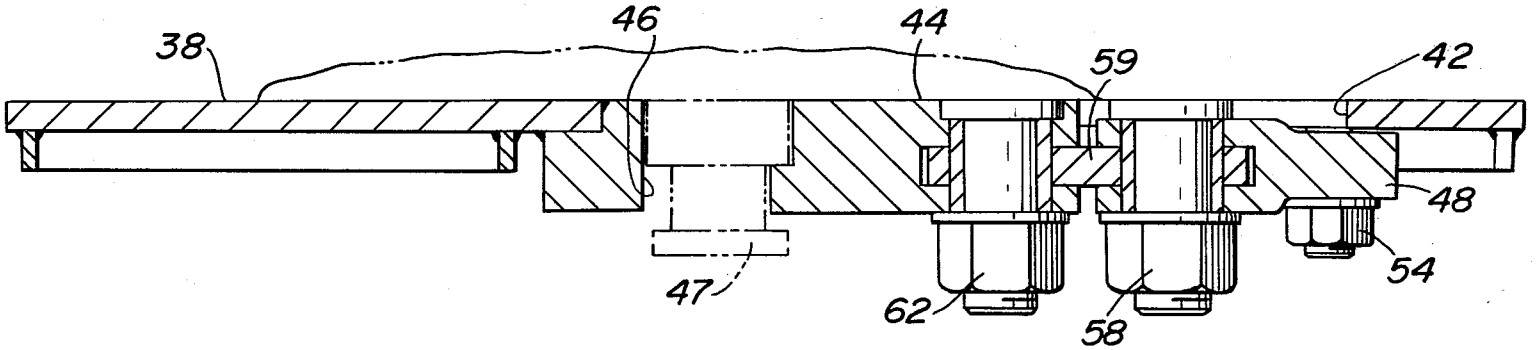
FIG. 5 is a cross-sectional view taken along lines 5—5 of FIG. 2.

As illustrated in FIGS. 3 and 5, the lever arm 48 is secured at one end to a pivot connection 54, which includes a suitable bearing, bolt and nut, and is adapted to be manually moved about this connection. The lever arm 48 is also connected by suitable connection beams 58 including a bolt connected to the top plate, bushing and nut. A link arm 59 connects the pivot connection 58 to a pivot connection 62, which also includes a bolt connected to the top plate, and a bushing and nut. When the lever 48 is moved in a clockwise direction with respect to FIG. 3, it is pivoted about pivot point 54 causing the link arm 59 to move to force the jaw 44 to move and open the hitch mechanism 24. In like manner, when it is desired to close the hitch mechanism 24, the lever arm 48 is moved in a counter-clockwise direction to cause the link arm 59 to force movement of the jaw 44 to close the hitch mechanism.

Figure 7:
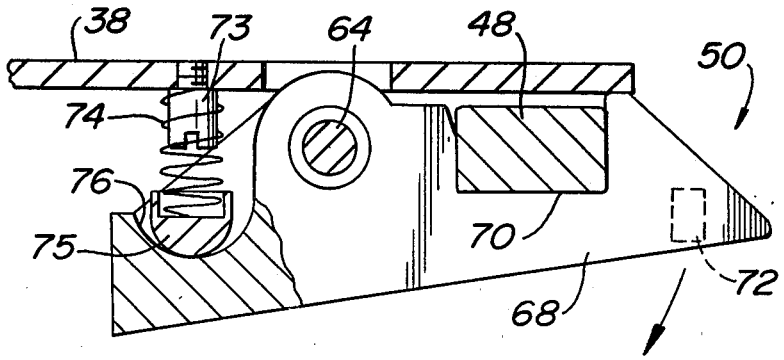
FIG. 7 is a cross-sectional view taken along lines 7—7 of FIG. 2.

Referring to FIG. 7, the latch mechanism 50 is rotatable about a pivot connection 64. The main latch element 68 includes a cut out groove or hook 70 to receive the lever arm 48 therein.

A compression spring 74 is held by a holder element 73 and is connected between the top plate 38 and a curved cam section 76 in the end of the main latch element 68. The spring has a cap 75 which is forced into the cam portion 76 at the end of the latch element 68 to bias it downwardly about the pivot connection 64. This prevents the lever arm 48 from being moved out of the locked position unless the latch is manually moved by an operator.

When it is desired to move the lever arm 48, it is necessary to move downwardly a handle 72 which is secured to the latch element 68. This movement overcomes the bias of the compression spring 74 to permit free movement of the lever arm 48.

What is claimed is:

1. A hitch mechanism for attachment to a freight car to selectively secure a locking element of a trailer to said freight car comprising:

(a) a main member;

(b) a fixed jaw member secured to said main member;

(c) a movable jaw member movably secured to said main member and spaced from said fixed jaw member to provide an opening therebetween to receive said locking element of said trailer when it is lowered into position;

(d) a manually movable lever arm pivotally connected at one end to said main member and disposed to be manually actuated at its other end and having a working portion intermediate said ends;

(e) a link element pivotally connected between said working portion of said lever arm intermediate said ends and said movable jaw member;

(f) said manually movable lever member pivoted on said main member being disposed to selectively drive said link element to move said movable jaw member to a closed position towards said fixed jaw member and to an open position away from said fixed jaw member to secure and release said locking element of said trailer;

(g) a manually movable latch mechanism pivotally mounted to said main member to automatically lock said lever member in said closed position and which manual operation of said latch mechanism is required to permit said lever member to be unlocked, (h) said latch mechanism inlcuding a pivotable latch arm attached to said main member, said latch arm including a recess and an angular portion at one end thereof, and spring means normally biasing said latch arm in a direction to receive said lever member in said recess; and (i) means providing an opening between said fixed and movable jaw members to receive and secure the locking element of said trailer when said hitch mechanism is closed.

2. A hitch mechanism as set forth in claim 1 wherein means for manually moving said latch arm are provided to overcome the bias of said spring means to move said one end away from said lever member.

3. A hitch mechanism as set forth in claim 2 wherein said angular portion of said arm is disposed to permit said lever member to engage and slide on said arm against the bias of said spring means when said lever member is manually moved to close said hitch mechanism.

4. A hitch mechanism as set forth in claim 3 wherein said locking element comprises a king pin of said trailer disposed to be lowered into an opening between said fixed and movable jaw members when said hitch mechanism is open.

* * * * *